US009085117B1

(12) United States Patent
Grimaldo

(10) Patent No.: US 9,085,117 B1
(45) Date of Patent: Jul. 21, 2015

(54) HYDRAULIC PRESS WITH SLIDABLE PLATENS

(71) Applicant: Samuel Grimaldo, Newbury Park, CA (US)

(72) Inventor: Samuel Grimaldo, Newbury Park, CA (US)

( * ) Notice: Subject to any disclaimer, the term of this patent is extended or adjusted under 35 U.S.C. 154(b) by 0 days.

(21) Appl. No.: 14/513,525

(22) Filed: Oct. 14, 2014

Related U.S. Application Data

(60) Provisional application No. 61/992,594, filed on May 13, 2014.

(51) Int. Cl.
*B30B 15/02* (2006.01)
*B30B 7/02* (2006.01)

(52) U.S. Cl.
CPC ..... *B30B 7/02* (2013.01)

(58) Field of Classification Search
CPC ..... B21D 37/14; B21D 43/13; B21D 37/04; B30B 7/02; B30B 15/30
USPC ..... 100/143, 183, 186, 193, 194, 195, 196, 100/199, 208, 209, 224, 251, 229 A, 229 R, 100/269.12, 295, 299, 918; 425/183, 186; 99/349, 353
See application file for complete search history.

(56) References Cited

U.S. PATENT DOCUMENTS

| | | | | | |
|---|---|---|---|---|---|
| 1,291,637 | A | * | 1/1919 | Burkhardt | 425/338 |
| 1,570,433 | A | * | 1/1926 | Carver | 100/199 |
| 1,607,722 | A | * | 11/1926 | Carver | 100/199 |
| 2,176,543 | A | * | 10/1939 | Norton | 83/563 |
| 2,226,920 | A | | 12/1940 | Carver | |
| 3,368,479 | A | * | 2/1968 | Gregorovich | 100/229 R |
| 3,427,855 | A | | 2/1969 | Michelson | |
| 3,752,060 | A | | 8/1973 | Hubert et al. | |
| 3,878,773 | A | | 4/1975 | Smit | |
| 3,926,032 | A | * | 12/1975 | Brooks et al. | 72/419 |
| 3,935,811 | A | * | 2/1976 | Lenz et al. | 100/346 |
| 3,942,431 | A | * | 3/1976 | Goff | 100/345 |
| 4,052,919 | A | * | 10/1977 | McKissack | 83/205 |
| 4,317,358 | A | * | 3/1982 | Yonezawa et al. | 72/448 |
| 4,408,950 | A | | 10/1983 | Laskey | |
| 4,587,830 | A | * | 5/1986 | Mills | 72/442 |
| 6,773,252 | B2 | * | 8/2004 | Furuhata | 425/186 |

FOREIGN PATENT DOCUMENTS

EP 1 854 622 A2 11/2007

* cited by examiner

*Primary Examiner* — Shelley Self
*Assistant Examiner* — Leonel Vasquez
(74) *Attorney, Agent, or Firm* — Ralph D. Chabot

(57) ABSTRACT

A hydraulic press with one or more slidable platens; each of which can be used as the working surface. Each slidable platen is horizontally positioned and vertically arranged relative to the other platens. Slidable platens reduce the time and effort for changing a working surface or desired tooling.

12 Claims, 4 Drawing Sheets

HYDRAULIC PRESS WITH SLIDABLE PLATENS

CROSS REFERENCE TO RELATED APPLICATIONS

This application claims the benefit of: U.S. provisional patent application bearing Ser. No. 61/992,594 filed May 13, 2014 the contents of which are hereby incorporated by reference herein in its entirety for all purposes.

BACKGROUND OF THE INVENTION

Hydraulic press machines are well known. In a typical embodiment, the common press is an 'H' frame type press table having 2 legs, each having a series of vertically spaced apart holes for receiving a pin or rod. The working surface also has a hole orientated with a respective leg. A rod or pin is slid thru the hole in a respective leg and associated working surface hole to secure the working surface in the desired vertical position. If the vertical height of the working surface is required to be adjusted to accommodate a particular object, the pins or rods are removed and the table must be raised or lowered to the desired position and the rods and pins reinserted into the table holes at a different height. To accomplish this, a fork lift or some type of a chain or cable mechanism for supporting the table load is used to manually adjust the height. This can oftentimes be time consuming and hazardous. For lighter presses, the adjustment can be performed manually.

SUMMARY OF INVENTION

A press machine is broadly disclosed that comprises a plurality of slidable platens. The press machine can be assembled to function as either a hydraulic press or a pneumatic press.

By way of example, a hydraulic press can be manufactured for tonnage ratings of between 5-200 tons. Depending on the size, the hydraulic press can be manufactured as either a floor model press or as a bench mounted press.

The press machine provides more than one working surface in the form of a plurality of slidable platens, each having different pre-determined elevations. Thus, it is no longer necessary to adjust the vertical elevation of the single working surface associated with prior art presses. Each platen is designed to preferably have either a square or rectangular working surface area. The thickness of the platen is sufficient to withstand the tonnage rating of the press.

As will be discussed later, rails are used to support each platen when displaced out of the forming position. Thus, the disclosed press machine does not require alignment of the working surface in a particular elevation and thereafter secure in place with rods or pins.

My press machine comprises:

a frame which comprises a pair of side walls and a cylinder mounting plate positioned upon the side walls;

a cylinder operated either hydraulically, pneumatically or electronically, and mounted upon the cylinder mounting plate where the cylinder is operably connected to a power supply and a control panel; and, a plurality of platens wherein each platen can be slid into and out of a first position; alternatively referred to as the forming position. A platen located in the first position, is set to function as the working surface so long as another platen is not positioned between it and the cylinder positioned vertically above.

The press machine may also include a base from which the side walls extend vertically upward. The base can be comprised of a unitized piece supporting both side walls or can be comprised of one or more separate parts acting together to support a respective side wall. The purpose of the base is to provide stability and weight distribution of the press machine across a floor surface. Alternatively, the portion of the side walls engaging the floor surface may comprise a sufficient area to provide for the necessary stabilization.

Both side walls have a front side, a rear side, an inner side and an outer side. The side walls extend vertically from the base and join with a cylinder mounting plate secured to both side walls at the top. The cylinder mounting plate has a central aperture and a cylinder is mounted upon the cylinder mounting plate with its cylinder piston positioned for vertical displacement through the cylinder mounting plate aperture. The distal end of the cylinder piston is configured for threadable engagement with either a ram or a piston extension.

A pair of slots, one slot in each side wall, is provided to support a respective platen positioned within the frame. The slots making up one pair are on the same horizontal plane meaning that they are of the same elevation. The slots extend from the rear side of the side wall and extend horizontally along the inner side of the respective side wall toward the front side. In a preferred embodiment, the slot design is U-shaped. The lower surface of the slot is defined as the bottom surface.

In a preferred embodiment, a plurality of horizontal reinforcement supports are mounted to each side wall across the front face and rear face of the frame, in close proximity above or below a respective slot pair. The reinforcement supports can be either bolted or welded to the side walls. These supports prevent the frame from buckling during a forming operation.

For each slot present in the frame is a corresponding horizontal rail having a proximal end, a distal end, and a top surface. Preferably, each rail is positioned having its proximal end adjacent to the end of the slot at the rear side. The top surface of the horizontal rail has the same vertical elevation as the bottom surface of the corresponding slot. In a preferred embodiment, each rail is braced to a respective side wall.

Between each pair of horizontal slots, a platen is provided and sized to be slidably received within. The slots also have to be appropriately dimensioned to properly support the weight of the platen as well as the force applied to the platen by the cylinder during a press cycle. The platen can be slidably displaced from the first position to a second position in which the platen is slidably displaced so it does not interfere with the piston displacement upon another platen being used as a working surface. Preferably, the second position is where the platen is slidably displaced away from contact with its respective slot pair and onto the corresponding rail pair.

Slidability of each platen allows for a faster change of the work surface. The platens of my invention can use their respective pair of rails to be slid into and displaced away from the forming position when desired.

By way of example, for a three shelf platen design as illustrated in the accompanying figures, there can exist three pairs of slots in the side walls of the device. Preferably, the rails are of sufficient length so that each platen can be slid out of engagement with the slots. This design permits the replacement of platens, if required. The bottom surface of the slots is defined as that portion of the slots upon which the platens will be positioned upon. It is thus necessary that the area of the bottom surface of each slot have the appropriate cross sectional area to support the weight of the platen as well as the force applied by the cylinder when a pressing operation is performed.

Insertion and retraction of each platen can be accomplished using well known means for displacement of heavy objects such as, but not limited to hydraulic, pneumatic, or electronic operatively configured for use with the platens of this invention. Also, displacement can be accomplished manually depending upon the tonnage of the press. Preferably, a lubricant is added to the bottom slot surfaces and top rail surface to reduce friction between platen and the rail and associated slot. In a preferred embodiment of my invention, each platen can be secured into place using set screws inserted through holes located in the side walls of the press frame which extend into a respective slot.

It is thus a feature of my invention to have slidable platens which can be moved away from the centerline of the hydraulic cylinder shaft while allowing tooling to remain in place on the respective platen, if desired.

Because the cylinder piston has a pre-determined stroke length, the use of slidable platens will vary the distance between the cylinder and tooling, depending upon which platen is in use at the time. Because the cylinder and piston will most likely not be designed to displace upon tooling placed upon the lowermost platen, properly sized piston extensions can be provided and are utilized to make up the vertical height difference. The distal end of the cylinder piston has a threadable engagement for attaching a piston extension or ram.

In an alternative embodiment, rail pairs can be incorporated on both the front side and rear side of the machine. Each rail pair having a respective platen slidably mounted upon. In other words, two slidable platens can be present for a respective slot pair so that both platens can be positioned in the second position and one of the platens can be slid into the first position to serve as the working surface. Numerous configurations can be design than the embodiments stated above. As an additional example, a press machine can be design having multiple slidable platens on one side of the press machine while only having one slidable platen on the opposite side. For this embodiment, the press machine would be positioned in an open working space where the operator can walk around the press in any direction and not have to reach through the press for any specific operation or access to mounting any specific tooling.

DETAILED DESCRIPTION OF THE PREFERRED EMBODIMENT

The figures are provided for illustration purposes and are not necessarily drawn to scale.

Figure 1A:
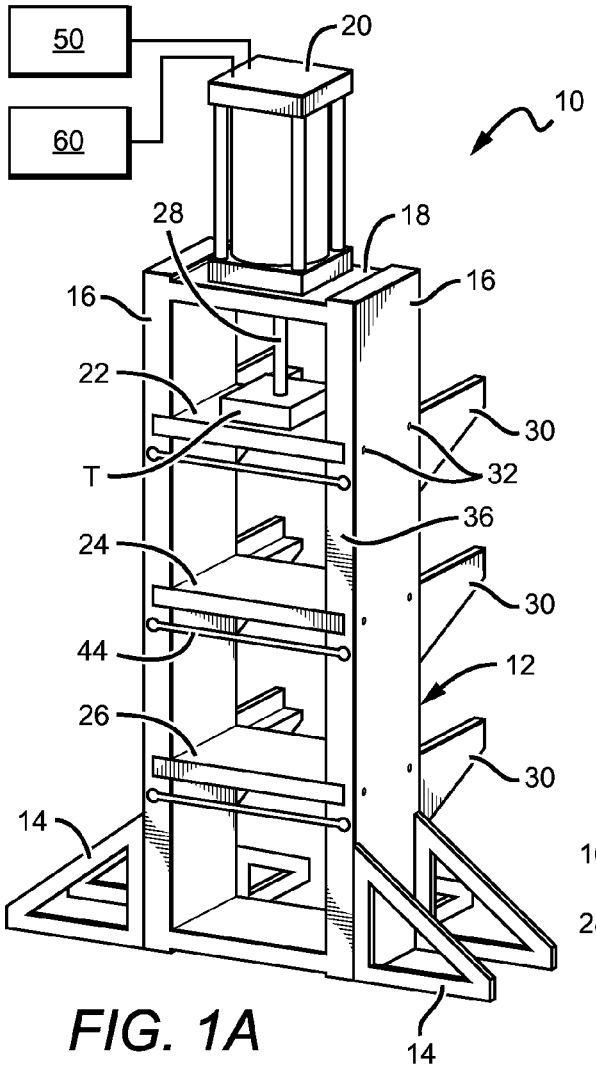
FIG. 1A is a front perspective view of my hydraulic press having three slidable platens with the top platen used as the working surface.
Figure 1B:
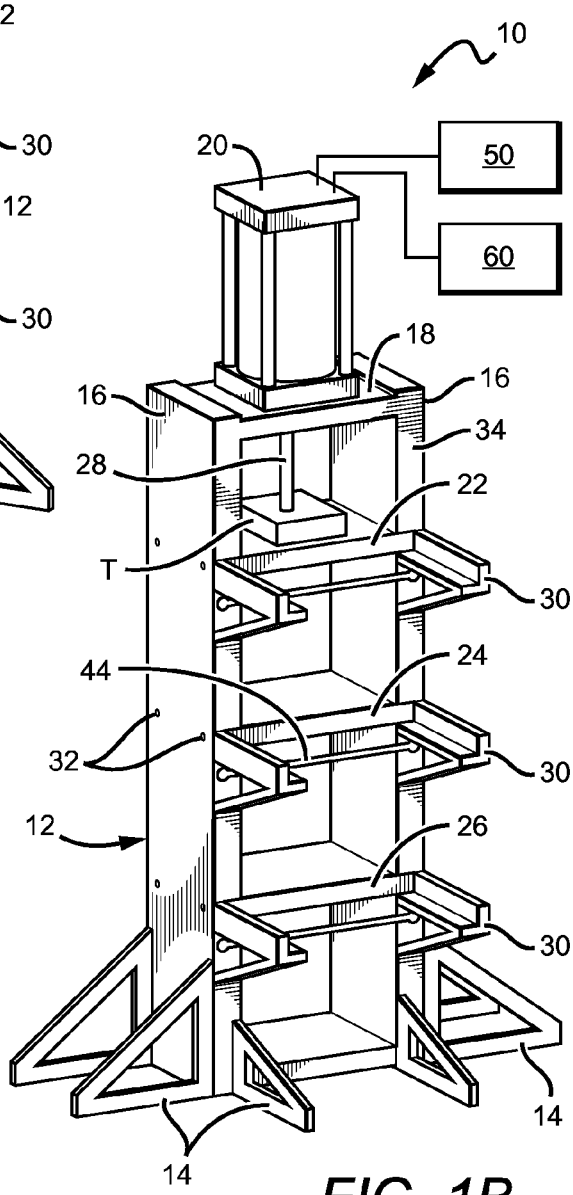
FIG. 1B is a rear perspective view of FIG. 1A.
Figure 2A:
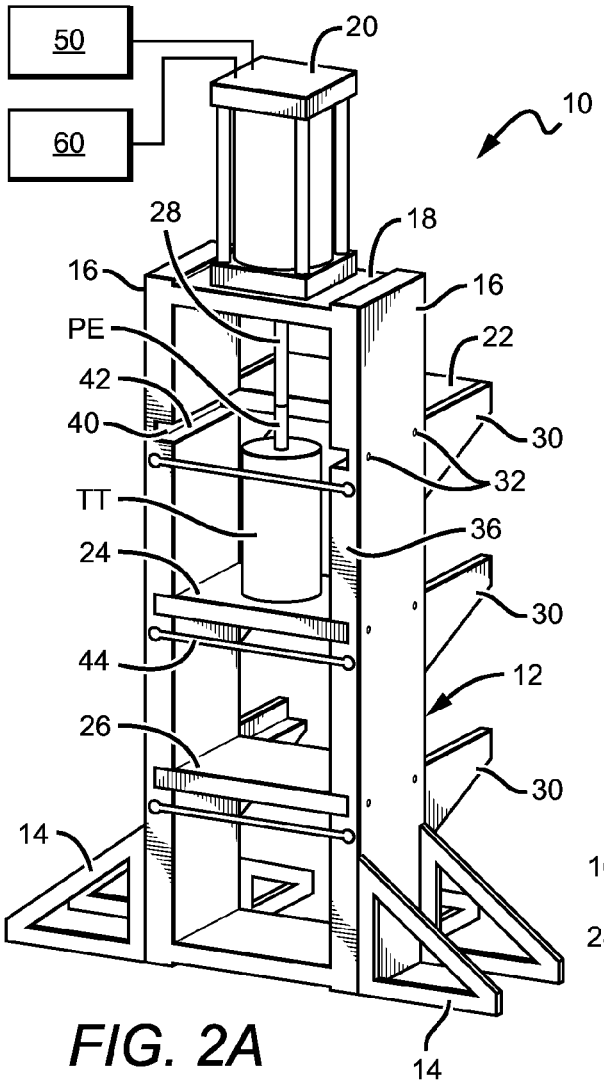
FIG. 2A is a front perspective view of my hydraulic press having three slidable platens with the middle platen used as the working surface.
Figure 2B:
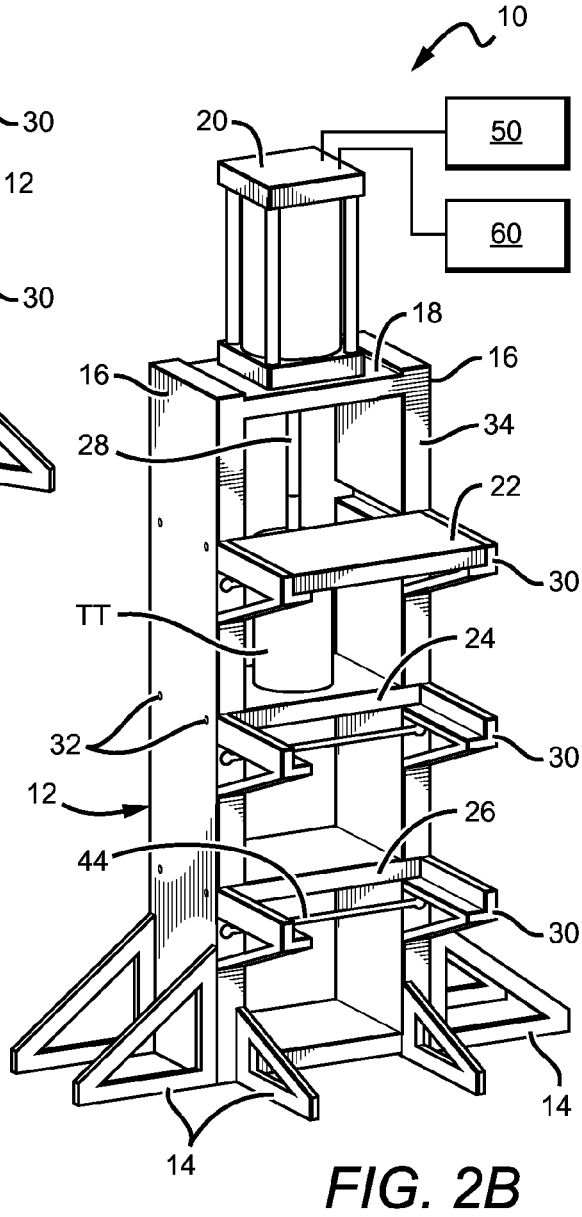
FIG. 2B is a rear perspective view of FIG. 2A.

FIGS. 1A and 1B illustrate a three slidable platen embodiment hydraulic press machine 10. Press machine 10 comprises a frame 12, base portions 14 which collectively define a base, side walls 16, cylinder mounting plate 18 and a hydraulic power cylinder 20 which is operably connected to an external power source 50. A control panel 60 is also provided operably connected to both external power source 50 and hydraulic power cylinder 20. As shown in FIGS. 2A and 2B, U-shaped horizontal slots 40 are cut into side walls 16 and are sized to slidably receive platens 22, 24 and 26. A pair of slots, one slot 40 in each side wall 16, is provided to support a respective platen positioned within frame 12. The slots extend from the rear face 34 of side wall 16 and extend horizontally along the inner side of the respective side wall 16 toward the front face 36. The lower surface 42 of slot 40 supports the weight of the respective platen when displaced into frame 12.

A plurality of horizontal reinforcement supports 44 are attached to both side walls 16 across the front face 36 and rear face 34 of the frame 12, in close proximity to a respective slot pair 40. Horizontal reinforcement supports 44 can be either bolted or welded to side walls 16.

Referring to FIG. 1A and FIG. 1B, top platen 22 is shown as the working surface in the first or forming position. This position is defined by the location of the platen vertically beneath hydraulic power cylinder 20. FIG. 1A and FIG. 1B also illustrate middle platen 24 and bottom platen 26 in the first position. Extending away from frame 12 are a respective pair of rails 30 for each platen to slidably displace upon. Lubricant is used to reduce friction. In the FIG. 1A illustration, tooling T is being worked upon top platen 22 using piston 28. Middle platen 24 and bottom platen 26 are not required for operation of the equipment and can be displaced on respective rails 30. Alternatively, platens not used for tooling can be used as a storage shelf if desired.

FIGS. 2A and 2B illustrate the same hydraulic press 10 as in FIGS. 1A and 1B but utilizing middle platen 24 as the working surface. An appropriately sized piston extension PE is attached to the distal end of piston 28 to provide sufficient length to perform the forming operation on tooling TT. As can be seen in FIG. 2B, top platen 12 must be slid upon respective rails 18 away from the center of press 10 so the piston 28 and piston extension PE can displace upon tooling TT.

If the pressing operation uses either top platen 22 or middle platen 24, bottom platen 26 can be positioned either in the first position or anywhere along respective rails 30 since it is not involved in the operation. Platens not involved in the pressing operation can be used for equipment storage.

Figure 3A:
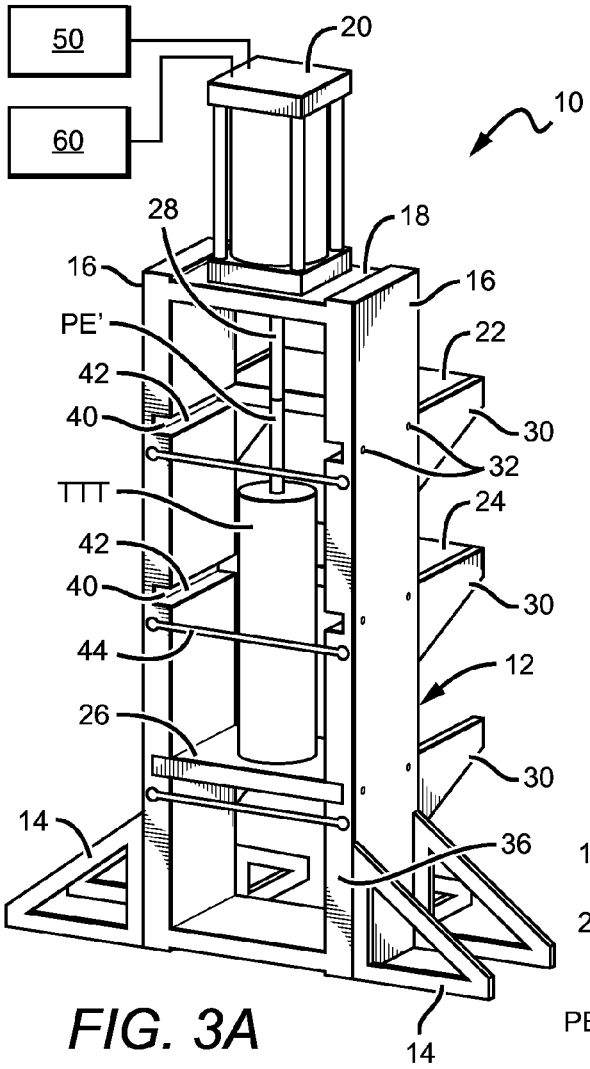
FIG. 3A is a front perspective view of my hydraulic press having three slidable platens with the lower platen used as the working surface.
Figure 3B:
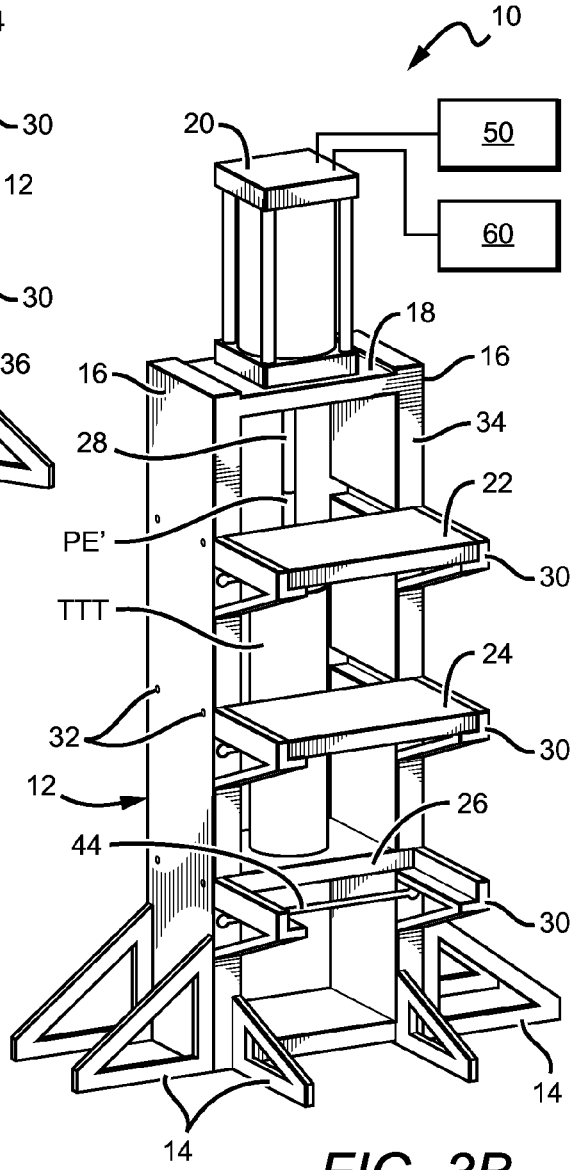
FIG. 3B is a rear perspective view of FIG. 3A.

FIGS. 3A and 3B illustrate the same hydraulic press but using bottom platen 26 as the working surface. A piston extension PE' having a longer length than piston extension PE used in FIGS. 2A and 2B is threadably attached to the distal end of piston 28 for working upon tooling TTT. As can be seen in FIG. 3B, top platen 12 and middle platen 14 must be slid upon respective platen rails 30 away from the center of machine 10 so the piston and extension can work properly upon tooling TTT. Top platen 22 and middle platen 24 can be used for storage while bottom platen 26 is used as the working surface.

Hydraulic press 10 further comprises holes 32 for threadable engagement with locking screws (not shown) that can be utilized to secure a platen when in the first position within respective slots 22. In the alternative, other ways can be used to secure the platen position for safety purposes. Safety stops (not shown) can also be incorporated to limit movement of the platens beyond a pre-determined point on respective platen rails 30.

A method for changing the working surface of a hydraulic press can be described as follows:

providing a press machine having a pair of side walls and vertically displaceable piston mounted above the sidewalls and positioned between the side walls and further having at least one slidable platen and a pair of respective horizontal rails extending in parallel relation away from the side walls for supporting a platen, where each of said platens can be used as a horizontal working surface and each platen is positioned in a vertical relationship to the other platens; said platens each slidable from a forming position located beneath said vertically displaceable piston to a second position in which each platen is supported by said horizontal rails;

selecting the platen to be used as a working surface;

sliding said selected platen into the forming position; and, sliding any platen positioned between said selected platen and said vertically displaceable piston into the second position.

Figure 4:
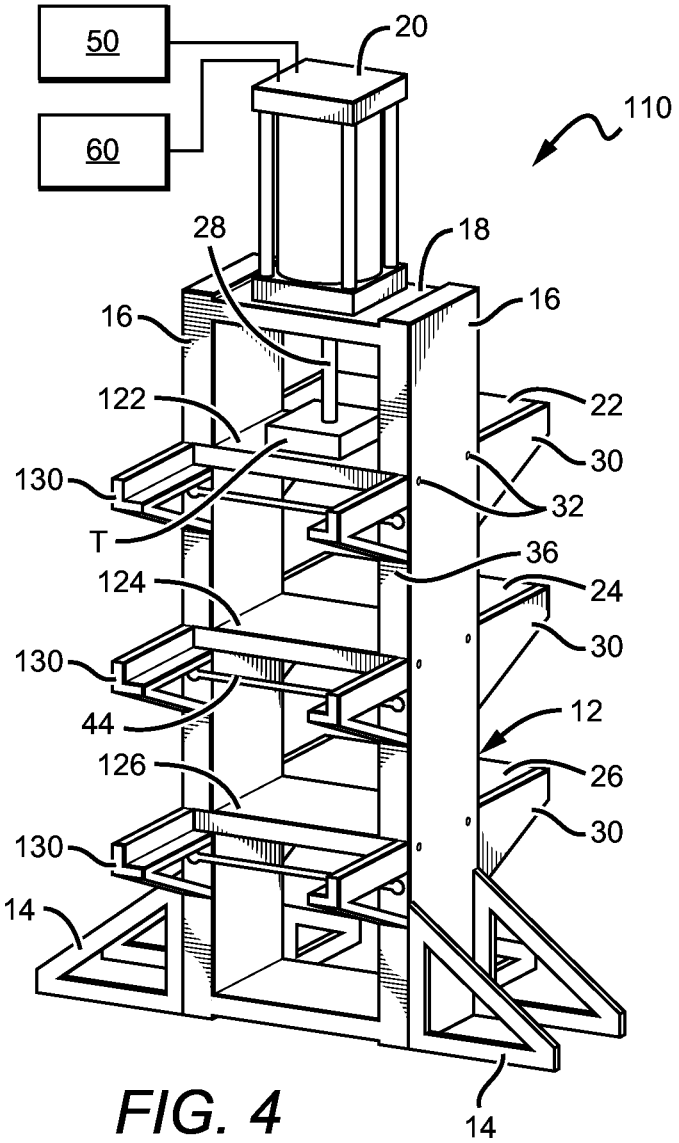
FIG. 4 is a front perspective view of an alternative embodiment.

FIG. 4 illustrates an alternative embodiment where a pair of slidable platens are provided for the same vertical elevation. Included in the alternative embodiment 110 are a second pair of horizontal rails 130 slidably supporting platens 122, 124 and 126. Platens 122, 124 and 126 are all shown in the first position and platens 22, 24, and 26 are shown in the second position. Platens 122, 124 and 126 are slidable onto respective rail pairs 130. The said second pair of horizontal rails 130 are positioned on the side of the press machine opposite from said first pair of horizontal rails 30.

I claim:

1. A press machine comprising:

a pair of side walls having a front side, a rear side, an inner side and an outer side;

a cylinder mounting plate horizontally positioned upon said pair of side walls; said cylinder mounting plate having a central aperture;

a cylinder mounted upon said cylinder mounting plate and having cylinder piston positioned for vertical displacement; said cylinder piston further having a distal end for threadable engagement with either a ram or a piston extension;

said central aperture further having a diameter larger than the outside diameter of a cylinder piston;

first pair of horizontal slots, one slot in one side wall and one slot in the other side wall, where said slots begin at the respective said rear side of each side wall and extend horizontally along the respective inner side of said side wall; said first pair of horizontal slots; each slot further having a bottom surface;

at least one additional pair of horizontal slots, located above said first pair of horizontal slots and in parallel relation;

one pair of horizontal rails for each pair of said horizontal slots, each of said rails having a proximal end, a distal end, and a top surface; each rail is positioned having its proximal end adjacent to a respective horizontal slot and where the top surface of said horizontal rail has the same vertical elevation as the bottom surface of said respective slot; and, a platen for each pair of horizontal slots, said platen sized to be slidably received within said pair of horizontal slots and displaceable from a first position in which at least a portion of said platen is located between said side walls to a second position in which said platen is supported by a respective pair of horizontal rails.

2. The press machine of claim 1 further comprising a control panel.

3. The press machine of claim 2 wherein said cylinder and said control panel are operably connected to an external power source.

4. The press machine of claim 1 further comprising at least one horizontal hole drilled through each side wall from said outer side to a respective slot.

5. The press machine of claim 1 further comprising at least one horizontal reinforcement support mounted across said front side to both side walls and at least one horizontal reinforcement support mounted across said rear side to both side walls.

6. The press machine of claim 1 further comprising a base for support of said side walls.

7. The press machine of claim 6 wherein said cylinder is operably connected to an external power source and a control panel.

8. The press machine of claim 2 further comprising at least one horizontal hole drilled through each side wall from said outer side to a respective slot.

9. The press machine of claim 2 further comprising at least one horizontal reinforcement support mounted across said front side to both side walls and at least one horizontal reinforcement support mounted across said rear side to both side walls.

10. In a press machine having a pair of side walls each having a front side, a rear side, an inner side and an outer side, where the side walls vertically extend upward; a cylinder mounting plate horizontally positioned upon the pair of side walls and supporting a cylinder and cylinder piston where the cylinder piston has a distal end for threadable engagement with either a ram or a piston extension, the improvement comprising:

at least two pairs of horizontal slots, the first slot of each pair in one side wall and the second slot of each pair in the other side wall, where said slots begin at the respective rear side of each side wall and extend horizontally along the respective inner side of said side wall; said respective pair of slots having the same elevation on each side wall; each slot further having a bottom surface; each pair of horizontal slots occupying a respective vertical elevation within each sidewall;

a first pair of horizontal rails for each pair of said horizontal slots, each of said rails having a proximal end, a distal end, and a top surface; each rail is positioned having its proximal end adjacent to a respective horizontal slot and where the top surface of said horizontal rail has the same vertical elevation as the bottom surface of said respective slot; and, a platen for each pair of horizontal slots, said platen sized to be slidably received within said pair of horizontal slots and displaceable from a first position in which at least a portion of said platen is located between said side walls to a second position in which said platen is supported by a respective pair of horizontal rails.

11. The press machine of claim 10 further comprising a second pair of horizontal rails for at least one pair of said horizontal slots and a respective second platen, each of said rails having a proximal end, a distal end, and a top surface; each rail is positioned having its proximal end adjacent to a respective horizontal slot and where the top surface of said horizontal rail has the same vertical elevation as the bottom surface of said respective slot; said second pair of horizontal rails positioned on the side of the press machine opposite from said first pair of horizontal rails; and where said platen is slidable upon the first respective pair of horizontal rails and the second platen is slidable upon the respective second pair of horizontal rails.

12. A method for changing the working surface of a hydraulic press machine, the method comprising the following steps:

providing a press machine having a pair of side walls and a vertically displaceable piston mounted above the sidewalls and positioned between the side walls and further having at least two slidable platens and a pair of respective horizontal rails extending in parallel relation away from the side walls for supporting a respective platen, where each of said platens can be used as a horizontal working surface and each platen is positioned in a vertical relationship to the other platens; said platens each slidable from a forming position located beneath said vertically displaceable piston to a second position in which each platen is supported by said horizontal rails;

selecting the platen to be used as a working surface;

sliding said selected platen into the forming position; and, sliding any platen positioned between said selected platen and said vertically displaceable piston into the second position.

* * * * *